US011892174B1

(12) United States Patent
Han

(10) Patent No.: US 11,892,174 B1
(45) Date of Patent: Feb. 6, 2024

(54) FOLDING STOVE

(71) Applicant: Xiajing Han, Ningbo (CN)

(72) Inventor: Xiajing Han, Ningbo (CN)

( * ) Notice: Subject to any disclaimer, the term of this patent is extended or adjusted under 35 U.S.C. 154(b) by 0 days.

(21) Appl. No.: 18/174,077

(22) Filed: Feb. 24, 2023

(30) Foreign Application Priority Data

Jan. 19, 2023 (CN) ..... 202320181237.9

(51) Int. Cl.
*F24C 3/14* (2021.01)
*F24C 15/10* (2006.01)
*F24C 3/12* (2006.01)

(52) U.S. Cl.
CPC ..... *F24C 3/14* (2013.01); *F24C 15/107* (2013.01); *F24C 3/126* (2013.01)

(58) Field of Classification Search
CPC ..... F24C 3/126; F24C 3/14; F24C 15/107
USPC ..... 126/38, 9 B, 9 R
See application file for complete search history.

(56) References Cited

U.S. PATENT DOCUMENTS 3,156,379 A * 11/1964 Felicien ..... F24C 3/14 222/83.5
4,284,058 A * 8/1981 Lutz ..... F24C 3/14 126/39 B
10,551,072 B1 * 2/2020 Blichmann ..... F24C 3/027

* cited by examiner

*Primary Examiner* — Vivek K Shirsat

(57) ABSTRACT

This disclosure provides a folding stove, including a base and a plurality of baking pan supporting feet. The baking pan supporting foot includes a supporting part and an installation part. The installation part is detachably connected with the base. The supporting part is rotatably connected with the installation part, and it is used for supporting the baking pan. Through the above structure, the user can rotate the baking pan supporting foot to the folding or unfolding position, so as to adjust the baking pan to a suitable height. The baking pan supporting foot can also be turned to the folding position so that the user can fold and carry it. Further, the baking pan supporting feet can be detached from the base, and the baking pan can be directly placed on the base, which brings convenience for storage and carrying.

20 Claims, 7 Drawing Sheets

FOLDING STOVE

CROSS-REFERENCE TO RELATED APPLICATIONS

The application claims priority of Chinese patent application 2023201812379, filed on 2023 Jan. 19, which is incorporated herein by reference in its entireties.

TECHNICAL FIELD

This disclosure relates to the field of stoves, in particular to a folding stove.

BACKGROUND

Present stoves on the market are usually equipped with baking pan supporting feet on a base of the stove. The present baking pan supporting feet, with a nonadjustable height, are fixedly connected with the base, resulting in the nonadjustable height of the baking pan and the inconvenience for storage and carrying. Thus, it is difficult for the present stove to meet practical needs of the user in different occasions, which greatly affects the user's experience. Therefore, there is an urgent need to provide a stove with adjustable baking pan supporting feet through which the user can adjust the height of the baking pan. This can meet practical needs of the user in different occasions and brings convenience for storage and carrying, which greatly improves the user's experience.

SUMMARY

In order to overcome the shortcomings of the prior art, this disclosure provides a folding stove with adjustable baking pan supporting feet through which the user can adjust the height of the baking pan. This can meet practical needs of the user in different occasions and brings convenience for storage and carrying, which greatly improves the user's experience.

The technical solution adopted by this disclosure to solve the technical problem is as follows:

The folding stove including a base and a plurality of baking pan supporting feet, wherein the baking pan supporting foot includes a supporting part and an installation part detachably connected with the base, the supporting part is rotatably connected with the the installation part through a first connecting part, and the supporting part is configured for supporting the baking pan.

Further, the folding stove includes a supporting frame detachably connected with an upper side of the base, and the support frame is rotatably connected with a lower side of the base through a second connecting part to support the base.

As an improvement of this disclosure, the supporting frame includes a plurality of first supporting frame unit and a plurality of second supporting frame unit, and the first supporting frame unit is connected with one side of the base, and the second supporting frame unit is connected with the other side of the base.

As an improvement of this disclosure, the base is provided with a chamber, and a stove head is disposed in the chamber.

As an improvement of this disclosure, the folding stove includes a tube, first connecting joint and second connecting joint, and one end of the tube is connected with the stove head through the first connecting joint, and the other end of the tube is connected with the second connecting joint, and the second connecting joint is configured for connecting a gas cylinder.

As an improvement of this disclosure, the supporting part is provided with a supporting edge and a stopping edge, and the stopping edge is used for stopping the baking pan from sliding out of the supporting edge.

As an improvement of this disclosure, the baking pan supporting feet are uniformly arranged around the stove chamber.

As an improvement of this disclosure, the number of the baking pan supporting feet of is 4.

As an improvement of this disclosure, a knob is arranged on the base, and the knob is connected with the first connecting joint to adjust gas supply of the gas cylinder.

As an improvement of this disclosure, the knob is arranged with a plurality of anti-skid protrusions disposed on the knob, and the anti-skid protrusion is in the shape of a pyramid.

As an improvement of this disclosure, a folding stove further includes a base and a plurality of baking pan supporting feet, wherein the baking pan supporting foot includes a supporting part and an installation part detachably connected with the base, the supporting part is rotatably connected with the the installation part, and the supporting part is configured for supporting the baking pan.

As an improvement of this disclosure, the folding stove includes a supporting frame detachably connected with an upper side of the base, and the support frame is rotatably connected with a lower side of the base through a connecting part to support the base.

As an improvement of this disclosure, the supporting frame includes a plurality of first supporting frame units and a plurality of second supporting frame units, and the first supporting frame units are connected with one side of the base, and the second supporting frame units are connected with the other side of the base.

As an improvement of this disclosure, the base is provided with a chamber, and a stove head is disposed in the chamber.

As an improvement of this disclosure, the folding stove includes a tube, a first connecting joint and a second connecting joint, and one end of the tube is connected with the stove head through the first connecting joint, and the other end of the tube is connected with the second connecting joint, and the second connecting joint is configured for connecting a gas cylinder.

As an improvement of this disclosure, the supporting part is provided with a supporting edge and a stopping edge, and the stopping edge is used for stopping the baking pan from sliding out of the supporting edge.

As an improvement of this disclosure, the baking pan supporting feet are uniformly arranged around the stove chamber.

As an improvement of this disclosure, the number of the baking pan supporting feet of is 4.

As an improvement of this disclosure, a knob is arranged on the base, and the knob is connected with the first connecting joint to adjust gas supply of the gas cylinder.

As an improvement of this disclosure, the knob is arranged with a plurality of anti-skid protrusions disposed on the knob, and the anti-skid protrusion is in the shape of a pyramid.

This disclosure provides a folding stove, including a base and a plurality of baking pan supporting feet. The baking pan supporting foot includes a supporting part and an installation part. The installation part is detachably connected with the base. The supporting part, which is rotatably connected with the the installation part through first connecting part, is used for supporting the baking pan. Through the above structure, the user can rotate the baking pan supporting feet to the folding or unfolding position, so as to adjust the height of the baking pan supporting feet, thus the user can adjust the baking pan to a suitable height. Moreover, the baking pan supporting feet can also be turned to the folding position so that the user can fold and carry it. Further, since the installation part is detachably connected with the base, the baking pan supporting feet are optional. They can be detached from the base when the user doesn't need them, and the baking pan can be directly placed on the base, which brings convenience for storage and carrying.

BRIEF DESCRIPTION OF THE DRAWINGS

In order to explain the technical solutions of the embodiments of this disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
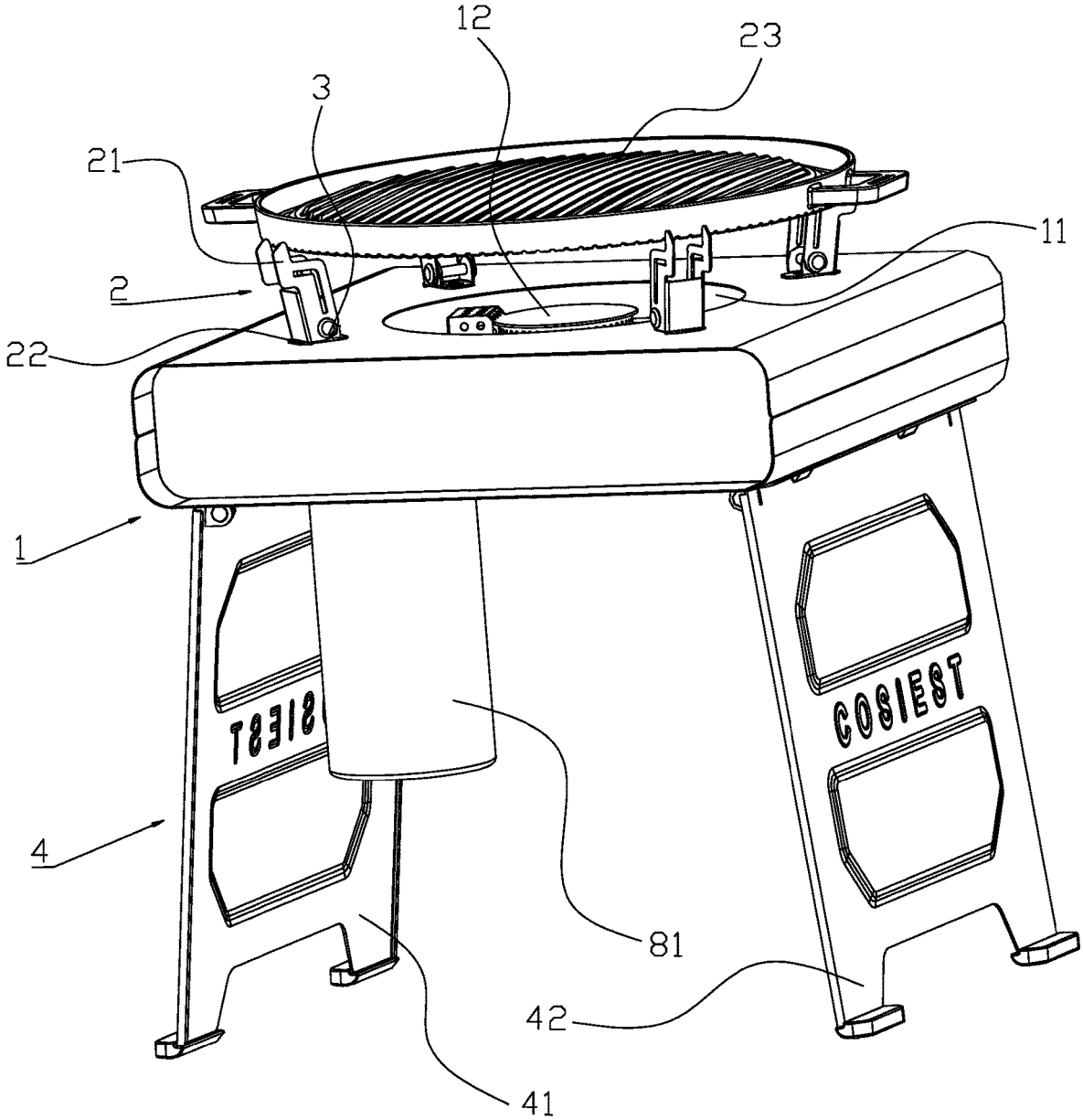
FIG. 1 is a schematic diagram of a supporting frame and baking pan supporting feet of a folding stove according to an embodiment of this disclosure when the folding stove is in an unfolding state.
Figure 2:
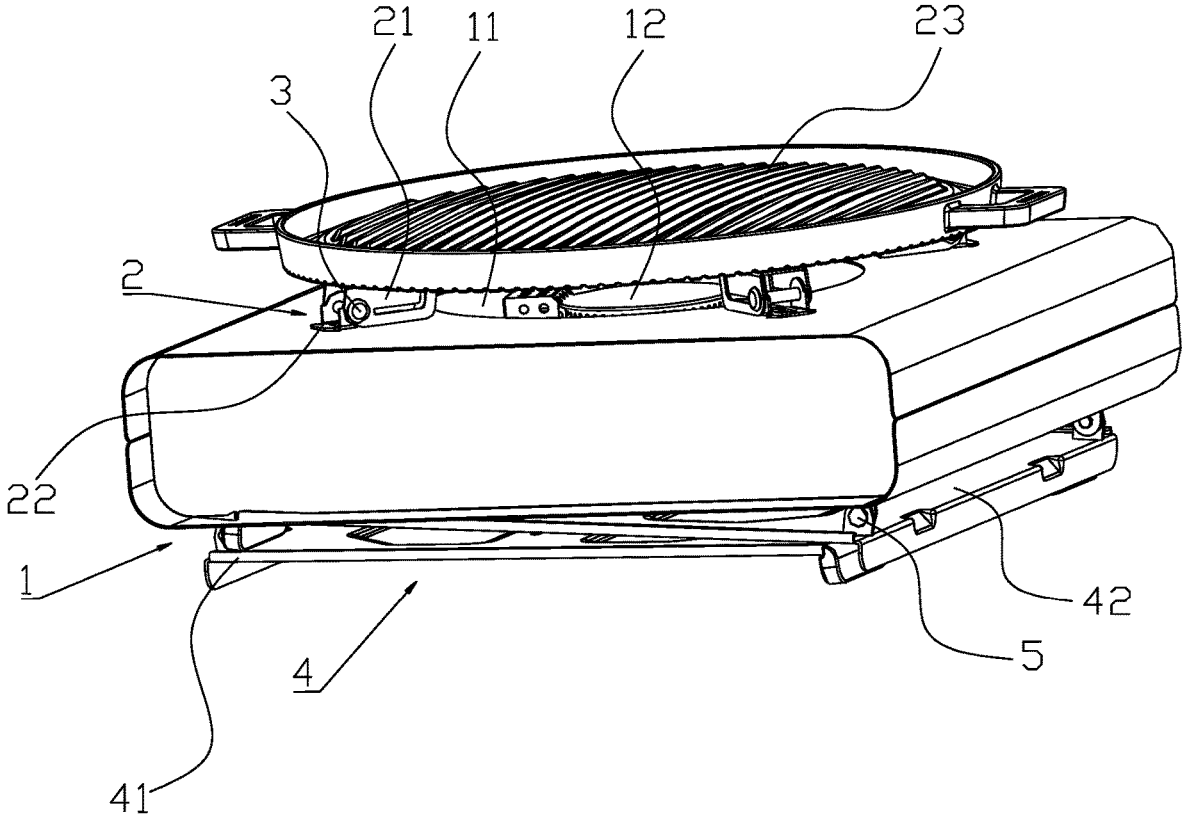
FIG. 2 is a schematic diagram of the supporting frame and baking pan supporting feet of FIG. 1 when the folding stove is in a folding state.
Figure 3:
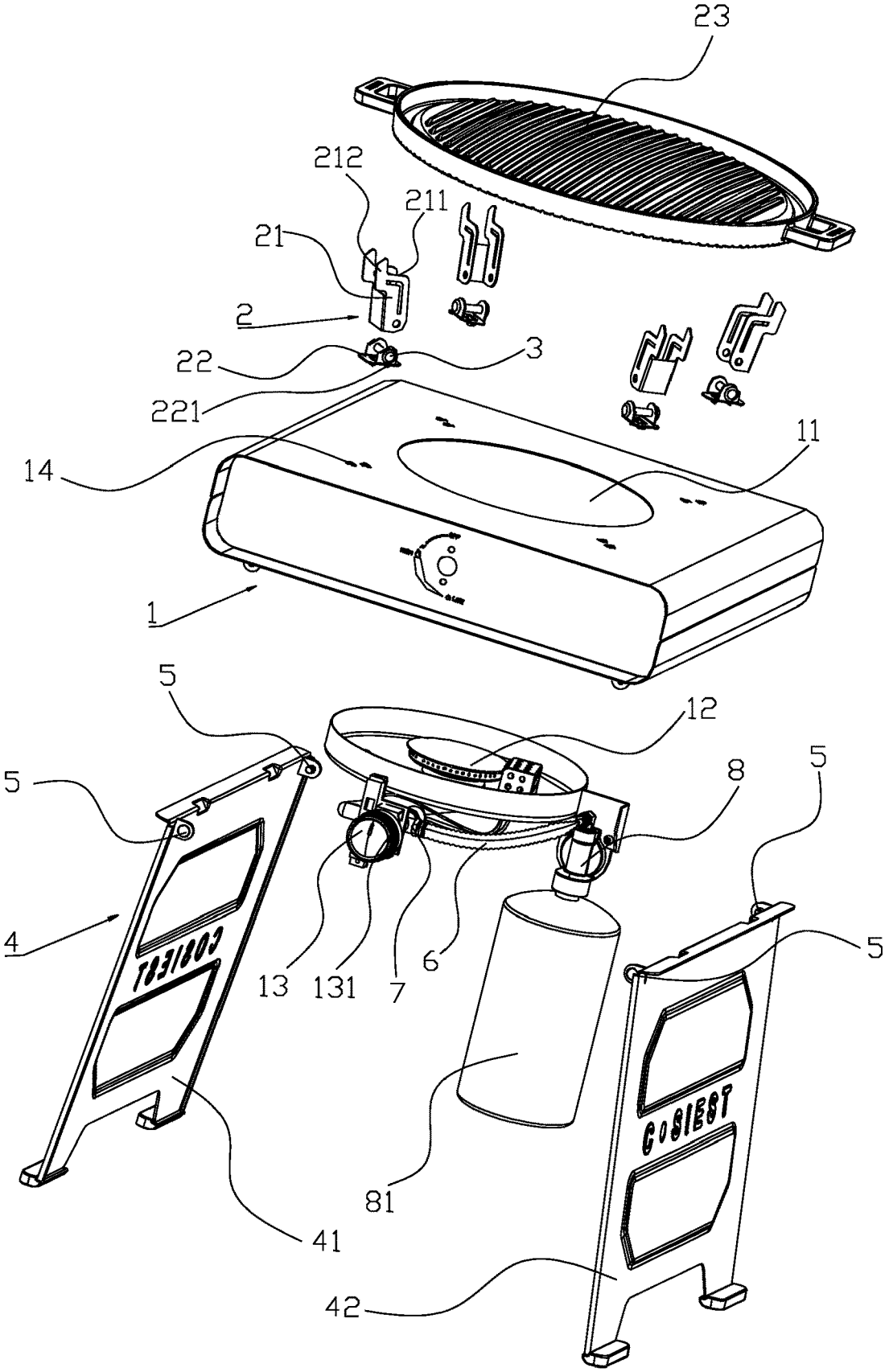
FIG. 3 is an exploded diagram of the folding stove of FIG. 1.
Figure 4:
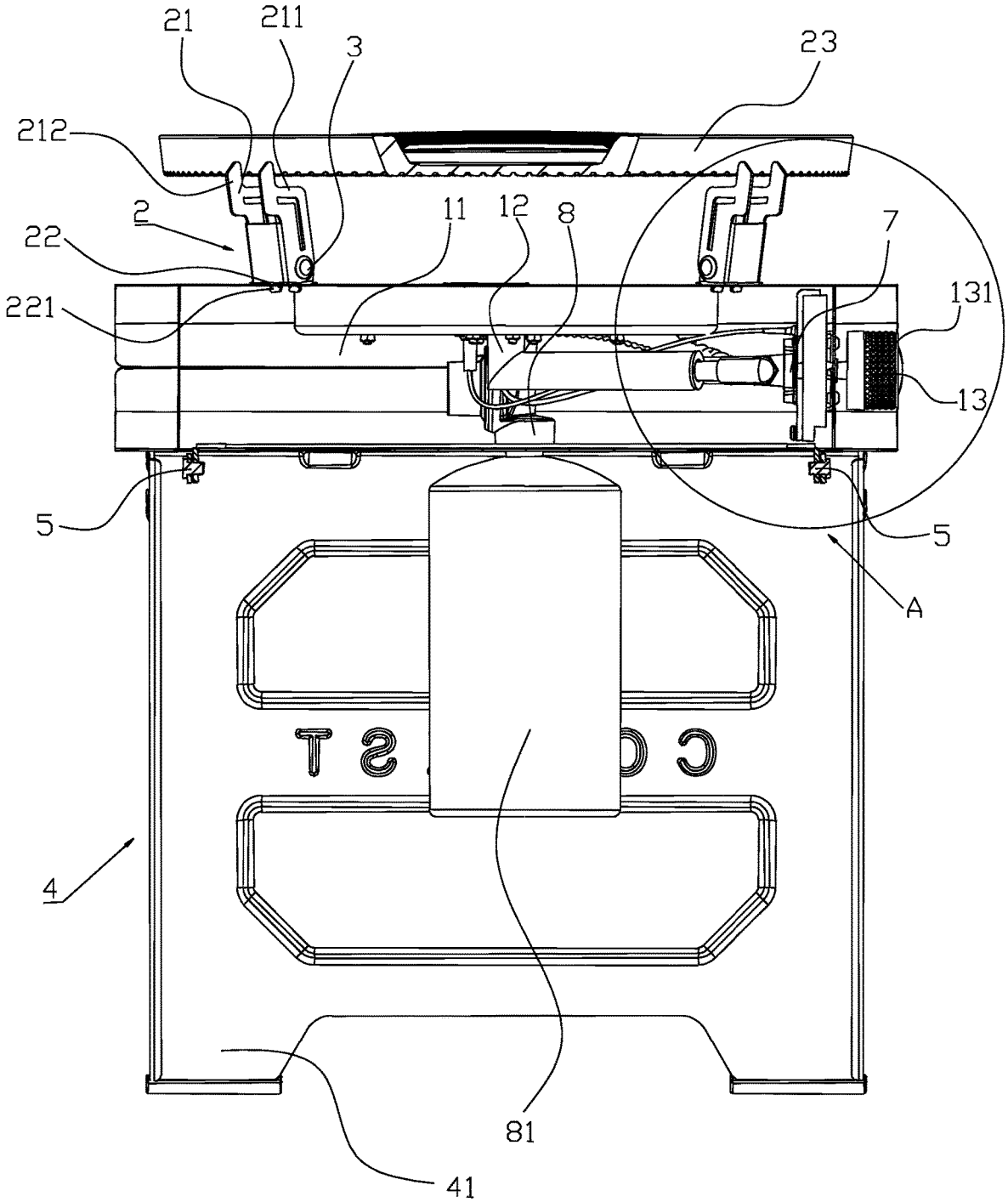
FIG. 4 is a cross-section view of the folding stove of FIG. 1 along a first connecting part and a supporting frame.
Figure 5:
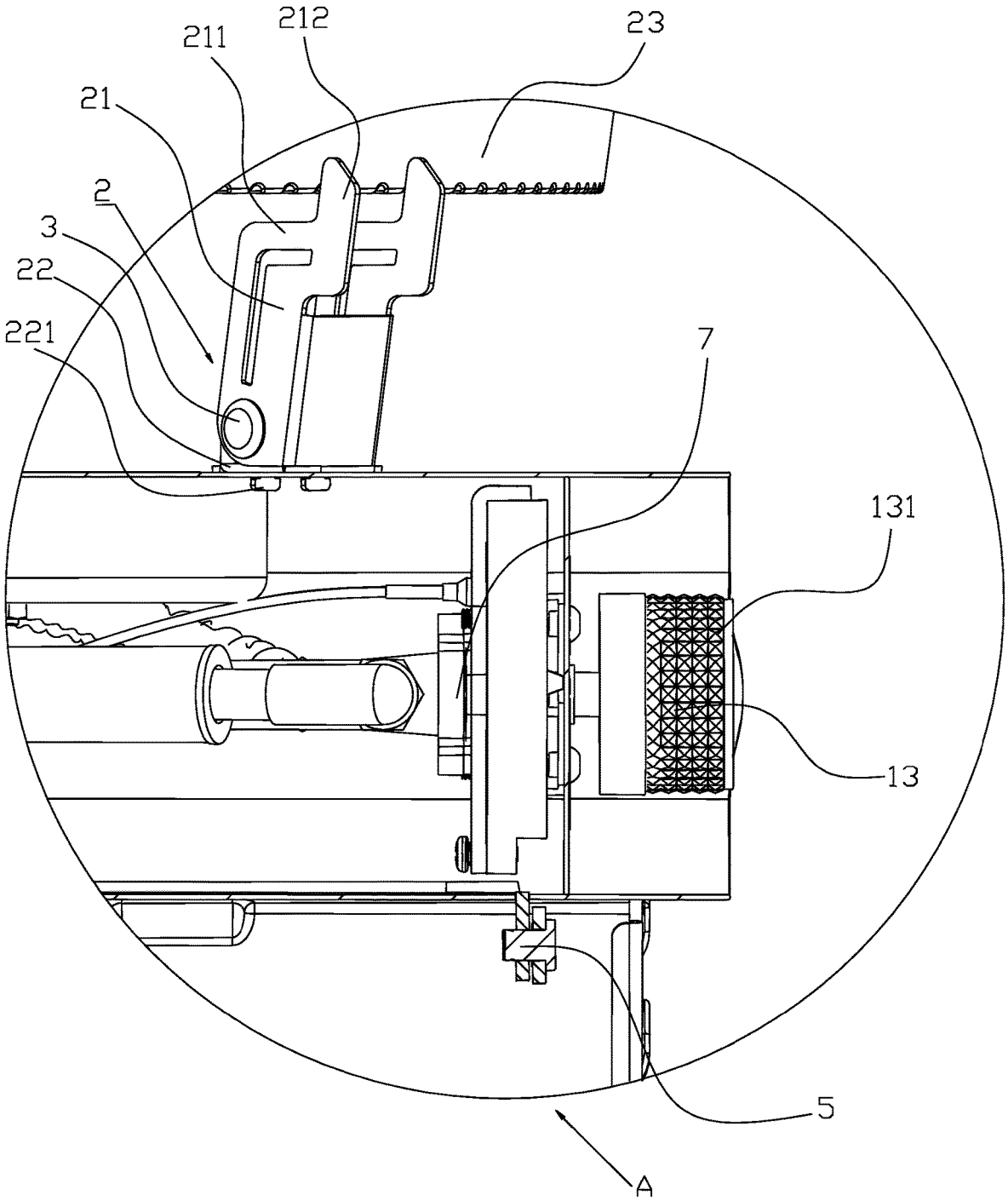
FIG. 5 is an amplified diagram of part A of FIG. 4.
Figure 6:
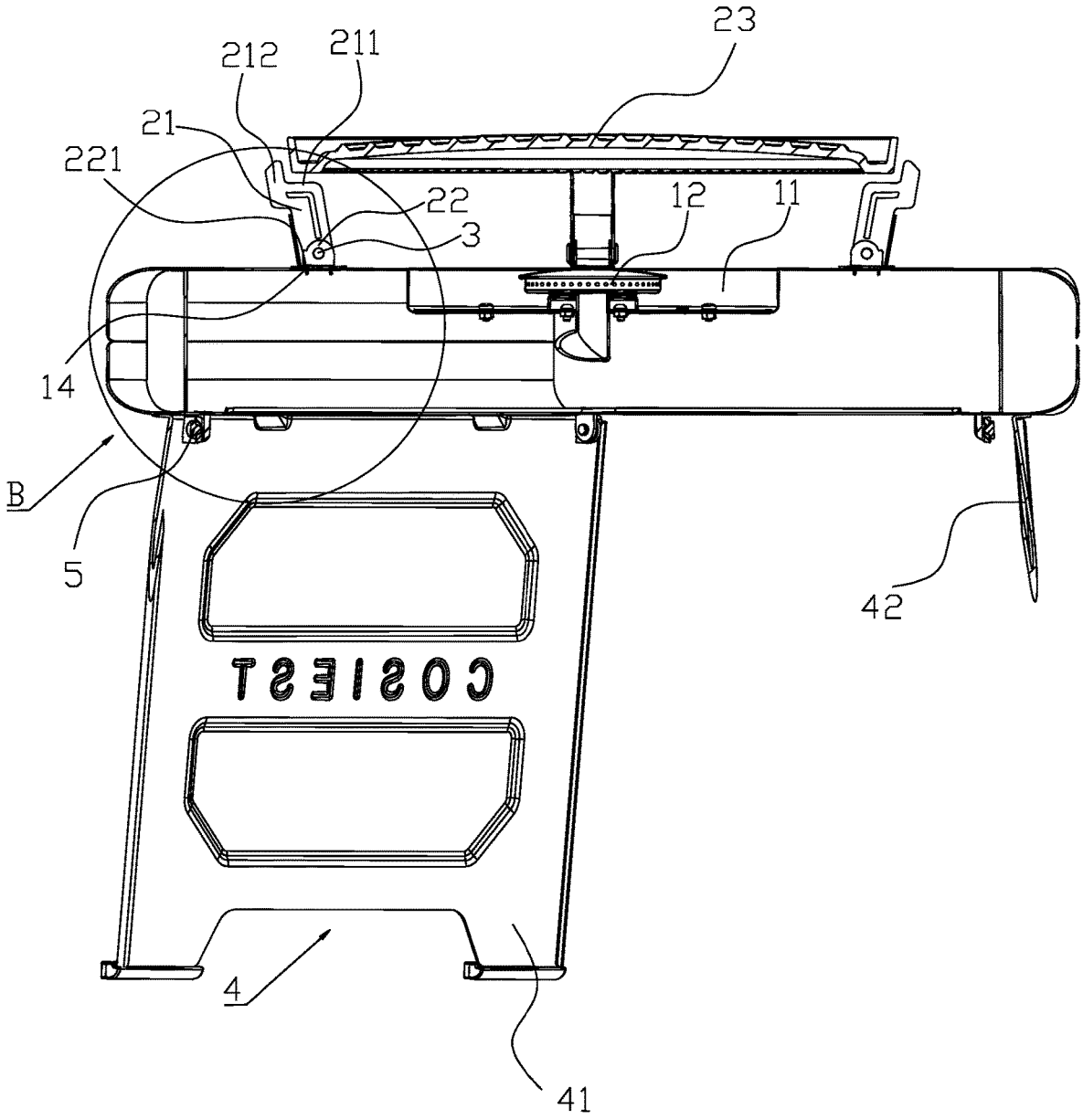
FIG. 6 is a cross-section view of the baking pan supporting foot.
Figure 7:
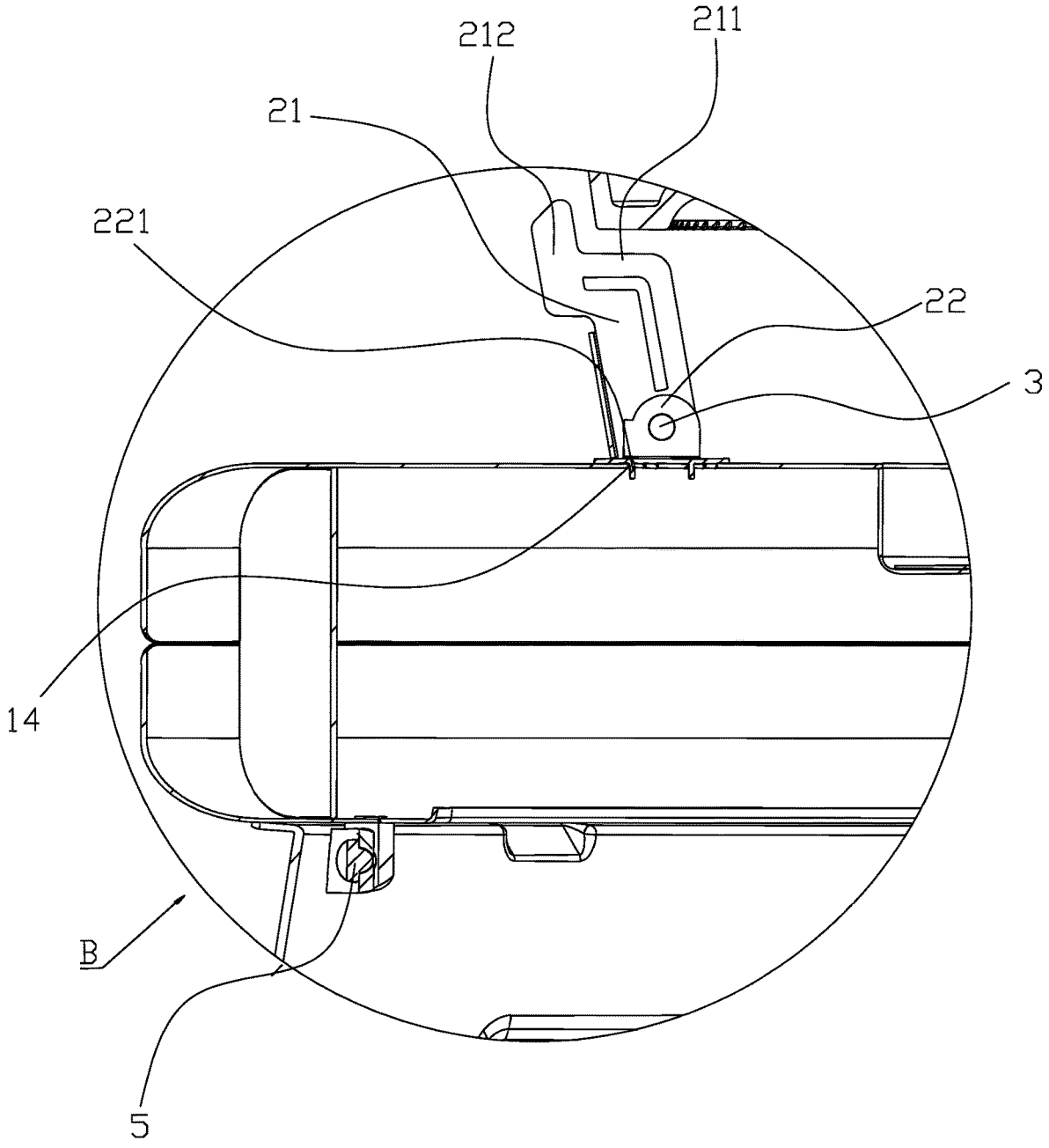
FIG. 7 is an amplified diagram of part B of FIG. 6.

Referring to FIG. 1 to FIG. 7, a folding stove includes a base 1 and a plurality of baking pan supporting feet 2. The baking pan supporting foot 2 includes a supporting part 21 and an installation part 22. The supporting part 21, which is rotatably connected with the the installation part 22 through a first connecting part 3, is used for supporting baking pan 23. The above structure includes a base and a plurality of baking pan supporting feet, and the baking pan supporting foot includes a supporting part and an installation part. The installation part is detachably connected with the base. The supporting part, which is rotatably connected with the the installation part through the first connecting part, is used for supporting the baking pan. The user can rotate the baking pan supporting feet to a folding or unfolding position to adjust the height of the baking pan supporting feet, thus the user can adjust the baking pan to a suitable height. Moreover, the baking pan supporting feet can also be turned to the folding position so that the user can fold and carry the stove. Further, since the installation part is detachably connected with the base, the baking pan supporting feet are optional. They can be detached from the base when the user doesn't need them, and the baking pan can be directly placed on the base, which brings convenience for storage and carrying.

In this embodiment, the installation part 22 is provided with a plug block 221, and the base 1 is provided with a plug port 14. The plug block 221 is inserted in the plug port 14 to realize the detachable connection between the installation part 22 and the base 1. Specifically, the first connecting part is a rotating shaft.

In this embodiment, the installation part 22 is detachably connected with the upper side of the base 1, and there is also a supporting frame 4, which is rotatably connected with the lower side of the base 1 through a second connecting part 5 to support the base 1. The supporting frame 4 includes a first supporting frame unit 41 and a second supporting frame unit 42. The first supporting frame unit 41 is rotatably connected with one side of the base 1 while the second supporting frame unit 42 is rotatably connected with the other side of the base 1. Specifically, the base 1 is provided with a stove chamber, and a stove head 12 is disposed in the chamber 11. Further, it also includes a tube 6, a first connecting joint 7 and a second connecting joint 8. One end of the tube 6 is connected with the stove head 12 through the first connecting joint 7, and the other end of the tube 6 is connected with the second connecting joint 8 which connects a gas cylinder 81. Further, the second connecting part is a rotating shaft. Through the above structure, since the first supporting frame unit is rotatably connected with one side of the base, and the second supporting frame unit is rotatably connected with the other side of the base, the user can rotate both of the units to the the unfolding position to adjust the height of the base and the baking pan. When the user needs to place the stove on the ground and use it, the accommodation space is sufficient if both of the supporting frame units can be rotated to the unfolding position. Then the second connection joint can be connected with a gas cylinder with larger capacity, such as a 10-pound or 20-pound cylinder. This can meet the higher powder need of the user in the occasion of landing usage. When the user needs to place the stove on the table for use, both of the supporting frame units can be turned to the folding position to adjust the base and the baking pan to a suitable position. Under this circumstance, because both of the supporting frame units are rotated to the folding position, the accommodation space is small, so that the second connection joint can be connected with the gas cylinder with smaller capacity, such as a 1-pound cylinder. This lower power can meet the user's desktop needs. Further, both of the supporting frame units can be turned to the folding position to reduce the size of the stove, and this brings convenience for storage and carrying when the user is in need.

In this embodiment, the supporting part 21 is provided with a supporting edge 211 and a stopping edge 212, and the stopping edge 212 is used for stopping the baking pan 23 from sliding out of the supporting edge 211. A plurality of baking pan supporting feet 2 are uniformly arranged around the circumference of the stove chamber 11. Specifically, the number of baking pan supporting foot 2 is 4. Through the above structure, the baking pan supporting frame uniformly arranged around the stove chamber can provide stable support for the baking pan, and the stopping edge can stop the baking pan on the supporting edge, which can effectively prevent the baking pan from sliding on the supporting foot of the baking pan. Moreover, this can ensure that the baking pan is located directly above the stove chamber and the stove head, so as to ensure that the baking pan is heated evenly.

In this embodiment, a knob 13 is also arranged on the base 1, and the knob 13 is connected with the first connecting joint 7 to adjust the gas supply of the gas cylinder 81. The knob 13 is arranged with a plurality of anti-skid protrusions 131 in the shape of a pyramid. Through the above structure, the user can adjust the gas supply through the knob, thereby adjusting the power of the stove, so that the user can adjust the stove to a suitable baking temperature. Moreover, because the knob is provided with anti-skid protrusions in the shape of a pyramid, it is not only beautiful in appearance, but also convenient for the user to adjust the stove temperature accurately and stably.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A folding stove, comprising a base and a plurality of baking pan supporting feet, wherein the baking pan supporting foot comprises a supporting part and an installation part detachably connected with the base, the supporting part is rotatably connected with the installation part through a first connecting part, and the supporting part is configured for supporting the baking pan, wherein the base is provided with a chamber, and a stove head is disposed in the chamber, wherein the folding stove comprises a tube, a first connecting joint and a second connecting joint, and one end of the tube is connected with the stove head through the first connecting joint, and the other end of the tube is connected with the second connecting joint, and the second connecting joint is configured for connecting a gas cylinder, wherein a knob is arranged on the base, and the knob is connected with the first connecting joint to adjust gas supply of the gas cylinder, wherein the knob is arranged with a plurality of anti-skid protrusions disposed on the knob, and the anti-skid protrusion is in the shape of a pyramid.

2. The folding stove according to claim 1, wherein the folding stove comprises a supporting frame detachably connected with an upper side of the base, and the support frame is rotatably connected with a lower side of the base through a second connecting part to support the base.

3. The folding stove according to claim 2, wherein the supporting frame comprises a first supporting frame unit and a second supporting frame unit, and the first supporting frame unit is connected with one side of a bottom plate of the base, the second supporting frame unit is connected with the other side of the bottom plate of the base, each of the first supporting frame unit and the second supporting frame unit is rotatably connected with the bottom plate of the base through a second connecting part to support the base such that the first supporting frame unit and the second supporting frame unit are able to rotate to be turned to a folding position or a unfolding position, when the first supporting frame unit and the second supporting frame unit are in the unfolding position, the first supporting frame unit and the second supporting frame unit are able to rotate to adjust a height of the base and the baking pan.

4. The folding stove according to claim 1, wherein the supporting part is provided with a supporting edge and a stopping edge, and the stopping edge is used for stopping the baking pan from sliding out of the supporting edge.

5. The folding stove according to claim 4, wherein the baking pan supporting feet are uniformly arranged around the stove chamber.

6. The folding stove according to claim 5, wherein the number of the baking pan supporting feet of is 4.

7. A folding stove, comprising a base and a plurality of baking pan supporting feet, wherein the baking pan supporting foot comprises a supporting part and an installation part detachably connected with the base, the supporting part is rotatably connected with the installation part, and the supporting part is configured for supporting the baking pan, wherein the base is provided with a chamber, and a stove head is disposed in the chamber, wherein the folding stove comprises a tube, a first connecting joint and a second connecting joint, and one end of the tube is connected with the stove head through the first connecting joint, and the other end of the tube is connected with the second connecting joint, and the second connecting joint is configured for connecting a gas cylinder, wherein a knob is arranged on the base, and the knob is connected with the first connecting joint to adjust gas supply of the gas cylinder, wherein the knob is arranged with a plurality of anti-skid protrusions disposed on the knob, and the anti-skid protrusion is in the shape of a pyramid.

8. The folding stove according to claim 7, wherein the folding stove comprises a supporting frame detachably connected with an upper side of the base, and the support frame is rotatably connected with a lower side of the base through a connecting part to support the base.

9. The folding stove according to claim 8, wherein the supporting frame comprises a first supporting frame unit and a second supporting frame unit, and the first supporting frame unit is connected with one side of a bottom plate of the base, the second supporting frame unit is connected with the other side of the bottom plate of the base, each of the first supporting frame unit and the second supporting frame unit is rotatably connected with the bottom plate of the base through a second connecting part to support the base such that the first supporting frame unit and the second supporting frame unit are able to rotate to be turned to a folding position or a unfolding position, when the first supporting frame unit and the second supporting frame unit are in the unfolding position, the first supporting frame unit and the second supporting frame unit are able to rotate to adjust a height of the base and the baking pan.

10. The folding stove according to claim 7, wherein the supporting part is provided with a supporting edge and a stopping edge, and the stopping edge is used for stopping the baking pan from sliding out of the supporting edge.

11. The folding stove according to claim 10, wherein the baking pan supporting feet are uniformly arranged around the stove chamber.

12. The folding stove according to claim 11, wherein the number of the baking pan supporting feet of is 4.

13. The folding stove according to claim 1, wherein the installation part is provided with a plug block, and an upper wall of the base is provided with a plug port, the plug block is inserted in the plug port to realize the detachable connection between the installation part and the base, the installation part comprises two installation plates facing each other and a first connection plate connected between the two installation plates, the plug block is connected a bottom surface of the first connection plate, and the two installation plates are rotatably connected with the supporting part.

14. The folding stove according to claim 4, wherein the supporting part comprises two supporting plates facing each other and a second connection plate connected between the two supporting plates, each supporting plate comprises the supporting edge and the stopping edge, an ends of each supporting plate is rotatably connected with the installation plates through a first connecting part.

15. The folding stove according to claim 7, wherein the installation part is provided with a plug block, and an upper wall of the base is provided with a plug port, the plug block is inserted in the plug port to realize the detachable connection between the installation part and the base, the installation part comprises two installation plates facing each other and a first connection plate connected between the two installation plates, the plug block is connected a bottom surface of the first connection plate, and the two installation plates are rotatably connected with the supporting part.

16. The folding stove according to claim 10, wherein the supporting part comprises two supporting plates facing each other and a second connection plate connected between the two supporting plates, each supporting plate comprises the supporting edge and the stopping edge, an ends of each supporting plate is rotatably connected with the installation plates through a first connecting part.

17. A folding stove, comprising a base and a plurality of baking pan supporting feet, wherein the baking pan supporting foot comprises a supporting part and an installation part detachably connected with the base, the supporting part is rotatably connected with the installation part, and the supporting part is configured for supporting the baking pan, the supporting frame comprises a first supporting frame unit and a second supporting frame unit, and the first supporting frame unit is connected with one side of the base, the second supporting frame unit is connected with the other side of the base, each of the first supporting frame unit and the second supporting frame unit is rotatably connected with the base through a second connecting part to support the base such that the first supporting frame unit and the second supporting frame unit are able to rotate to be turned to a folding position or a unfolding position, when the first supporting frame unit and the second supporting frame unit are in the unfolding position, the first supporting frame unit and the second supporting frame unit are able to rotate to adjust a height of the base and the baking pan.

18. The folding stove according to claim 17, wherein the installation part is provided with a plug block, and an upper wall of the base is provided with a plug port, the plug block is inserted in the plug port to realize the detachable connection between the installation part and the base, the installation part comprises two installation plates facing each other and a first connection plate connected between the two installation plates, the plug block is connected a bottom surface of the first connection plate, and the two installation plates are rotatably connected with the supporting part.

19. The folding stove according to claim 17, wherein the supporting part comprises two supporting plates facing each other and a connection plate connected between the two supporting plates, an ends of each supporting plate is rotatably connected with the installation plates through a first connecting part.

20. The folding stove according to claim 17, wherein each of the first supporting frame unit and the second supporting frame unit comprises a base plate, an extending plate connected an upper side of the base plate and extending toward an outer side of the base plate, and two supporting legs connected an lower side of the base plate, and the second connecting part is connected an inner side of the base plate.

* * * * *